US006464803B1

(12) United States Patent
Tendo et al.

(10) Patent No.: US 6,464,803 B1
(45) Date of Patent: Oct. 15, 2002

(54) STAINLESS STEEL FOR BRAKE DISC EXCELLENT IN RESISTANCE TO TEMPER SOFTENING

(75) Inventors: Masayuki Tendo; Masao Kikuchi, both of Futtsu; Toshio Tanoue, Tokyo; Kiyoshi Yamaji, Kitakyushu, all of (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 09/652,191

(22) Filed: Aug. 31, 2000

(30) Foreign Application Priority Data

Nov. 30, 1999 (JP) ..... 11-339667

(51) Int. Cl.[7] ..... C22C 38/18
(52) U.S. Cl. ..... 148/325; 148/326
(58) Field of Search ..... 148/505, 506, 148/507, 325, 326; 420/34, 68, 69

(56) References Cited

U.S. PATENT DOCUMENTS

| | | | | |
|---|---|---|---|---|
| 2,469,387 A | | 5/1949 | Olcott | |
| 4,261,739 A | | 4/1981 | Douthett et al. | |
| 4,452,649 A | | 6/1984 | Yoshioka et al. | |
| 4,902,473 A | * | 2/1990 | Arata et al. | 420/105 |
| 4,917,738 A | * | 4/1990 | Takano et al. | 148/325 |
| 5,061,440 A | * | 10/1991 | Watanabe et al. | 420/38 |
| 5,462,611 A | | 10/1995 | Uematsu et al. | |
| 5,979,614 A | | 11/1999 | Takahashi et al. | |

FOREIGN PATENT DOCUMENTS

| | | | |
|---|---|---|---|
| JP | 60149744 | * | 8/1985 |
| JP | 63100105 | * | 5/1988 |

OTHER PUBLICATIONS

Database WPI Week 198328, Derwent Publications Ltd., London, GB; AN 1983–709615 XP002163557 & SU 954 492 A (Uralmash Prod. Asscn.), Aug. 30, 1982.

* cited by examiner

*Primary Examiner*—Sikyin Ip
(74) *Attorney, Agent, or Firm*—Kenyon & Kenyon

(57) ABSTRACT

Brake disc produced by a hot-rolled stainless steel excellent in resistance to temper softening, characterized in that: said steel contains, in terms of wt %, C: 0.01 to 0.1%, N: 0.03% or less, C+N: 0.04 to 0.1%, Si: 1% or less, Mn: 20 or less, Ni: less than 0.5%, Cr: 10 to 15%, and Nb: 0.02% to 0.5%, with the balance Fe and unavoidable impurities; that the hardness after quenching heat treatment is in the range of 30 to 40 HRC; and that the temper softening temperature for lowering the hardness to below 30 HRC is at least 530° C. Further, it is desirable to add at least one of the following elements; 0.1 to 2% of Cu, 0.1 to 1% of Mo, 0.01 to 0.5% of Ti, 0.01 to 0.5% of V or 0.0005 to 0.01% of B, and to make the value of $\gamma_p$ calculated from steel chemical composition at least 70%.

3 Claims, 1 Drawing Sheet

STAINLESS STEEL FOR BRAKE DISC EXCELLENT IN RESISTANCE TO TEMPER SOFTENING

BACKGROUND OF THE INVENTION

1. Field of the Invention

The present invention relates to a stainless steel, for a brake disc, excellent in resistance to temper softening and, more specifically, to a martensitic stainless steel having excellent resistance to softening resulting from heat generation caused by braking, as well as satisfying the hardness, hardenability and rusting resistance required of a material for a brake disc of a two-wheeled vehicle, a snowmobile or the like.

2. Description of the Related Art

A material for a brake disc of a two-wheeled vehicle, etc., is required to have properties such as abrasion resistance, rusting resistance and toughness and a JIS SUS410 type martensitic stainless steel has been mainly used for such applications. Although abrasion resistance is generally improved as hardness is increased, so-called brake noise is generated, by the contact between brake and pads, when the hardness is too high. The hardness of a brake disc is, therefore, controlled to within a prescribed range.

In order to stably control the hardness to within a prescribed range after quenching heat treatment and to ensure sufficient toughness and rusting resistance, the chemical compositions of steels with regulated amounts of Mn, Cu, etc., as well as C+N, are disclosed in Japanese Unexamined Patent Publications No. 57-198249, No. 59-70748 and No. 10-152760 and Japanese Published Patent No. 2-7390. Namely, these represent methods to obtain desired hardness after quenching by controlling the contents of C and N, preceded by sufficiently ensuring the austenite phase at a high temperature by controlling the contents of Mn and Cu in steel. Owing to these chemical compositions, it has been possible to provide materials for brake discs for two-wheeled vehicles satisfying abrasion resistance, rusting resistance and toughness.

In the meantime, the performance of recent two-wheeled vehicles calls for higher braking force at higher speed and it is required that the material properties, especially hardness, of a brake disc do not deteriorate when the disc is heated to a temperature exceeding 500° C. during braking. Since the above-mentioned steels have a matrix of martensitic phase, however, they undergo temper softening when heated to a temperature exceeding 500° C. And thus the development of a material for a brake disc satisfying the above requirements has been sought.

SUMMARY OF THE INVENTION

An object of the present invention is to provide a stainless steel for a brake disc less susceptible to deterioration of material properties, especially the deterioration of hardness, when heated to a temperature exceeding 500° C. during braking, while maintaining the abrasion resistance, rusting resistance and toughness of a conventional steel.

In order to attain the above-mentioned object, the present inventors investigated and experimentally studied chemical compositions and additive elements which do not impair the original properties required of a brake disc and do not significantly increase the cost. As a result, the present inventors found that the temper softening temperature for lowering the hardness to below 30 HRC (Rockwell hardness C scale) can be increased by 30° to 100° C. or more by restricting the range of chemical composition so as to maintain the hardness after quenching, which relates to the abrasion resistance, in the range of 30 to 40 HRC, preferably 32 to 38 HRC and so as not to deteriorate rusting resistance and toughness, and then by adding an appropriate amount of Nb which suppresses temper softening.

The present invention was completed based on the above-described knowledge and the gist of the present invention is as follows:

(1) A stainless steel for a brake disc excellent in resistance to temper softening, characterized in that: said steel contains, in terms of wt %, C: 0.01 to 0.1%, N: 0.03% or less, C+N: 0.04 to 0.1%, Si: 1% or less, Mn: 2% or less, Ni: less than 0.5%, Cr: 10 to 15%, and Nb: 0.02 to 0.5%, with the balance Fe and unavoidable impurities; wherein the hardness after quenching heat treatment is in the range of 30 to 40 HRC; and the temper softening temperature for lowering the hardness to below 30 HRC is at least 530° C.

(2) A stainless steel for a brake disc excellent in resistance to temper softening according to item (1), characterized by further containing, in terms of wt %, at least one of the following elements:

Cu: 0.1 to 2%, or

Mo: 0.1 to 1%.

(3) A stainless steel for a brake disc excellent in resistance to temper softening according to item (1) or (2), characterized by further containing, in terms of wt %, at least one of the following elements:

Ti: 0.01 to 0.5%,

V: 0.01 to 0.5%, or

B: 0.0005 to 0.01%.

(4) A stainless steel for a brake disc excellent in resistance to temper softening according to any one of items (1) to (3), characterized in that the value of $\gamma_p$ calculated from the steel chemical composition as expressed below is at least 70%.

$$\gamma_p=420\times[\%\ C]+470\times[\%\ N]+23\times[\%\ Ni]+9\times[\%\ Cu]+7\times[\%\ Mn]-11.5\times[\%\ Cr]-11.5\times[\%\ Si]-12\times[\%\ Mo]-47\times[\%\ Nb]-52\times[\%\ Al]-49\times[\%\ Ti]-23\times[\%\ V]-500\times[\%\ B]+189$$

DESCRIPTION OF THE PREFERRED EMBODIMENTS

Figure 1:
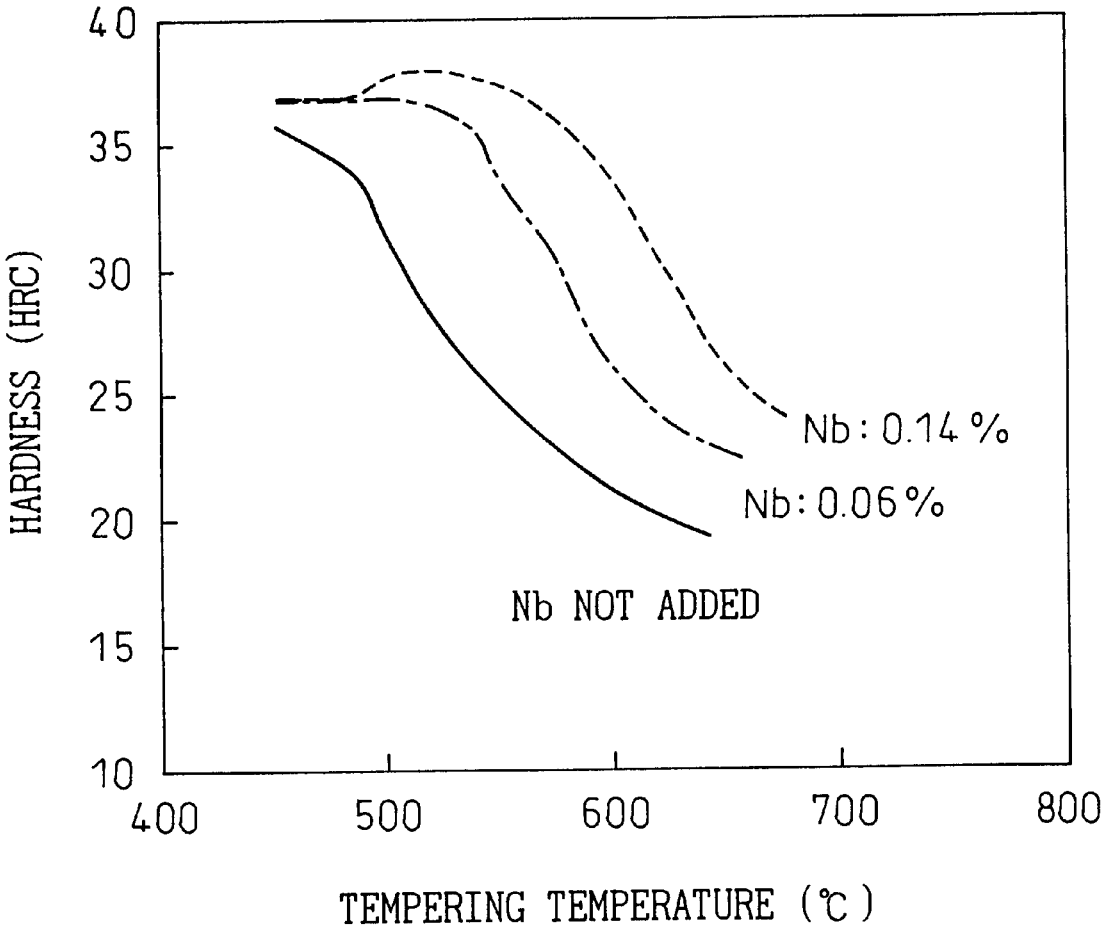
FIG. 1 is a graph showing the relationship between the tempering temperature and the hardness of the steels in which 0.06% and 0.14% of Nb is added, respectively, in comparison with a conventional steel in which Nb is not added.

The embodiments and the restricting conditions of the present invention will be described in detail. C is an indispensable element to obtain a prescribed hardness after quenching and, hence, is added in combination with N so that the desired hardness level is achieved. However, since its addition beyond 0.1% raises the hardness excessively and causes drawbacks such as brake noise and the deterioration of toughness, the upper limit is set at 0.1%. On the other hand, when its amount is below 0.01% an excessive amount of N is required for obtaining the desired hardness and, for this reason, the lower limit is set at 0.01%.

N is, like C, an indispensable element to obtain a prescribed hardness after quenching and, hence, is added in combination with C so that the desired hardness level is achieved. However, since its addition beyond 0.03% significantly deteriorates toughness due to the precipitation of fine Nb nitrides during heat generation caused by braking, the upper limit is set at 0.03%.

Si, which is inevitably included in steel, is effective as a deoxidizing agent. However, its addition beyond 1% markedly lowers toughness after quenching heat treatment and therefore the upper limit is set at 1%.

Mn, which is also inevitably included in steel, is an element effective to secure the austenite phase at a high temperature and to ensure hardenability. However, its addition above 2% deteriorates rusting resistance and therefore the upper limit is set at 2%.

Ni, which is inevitably included in a small quantity in steel during an industrial smelting process, is an element effective, like Mn, to secure the austenite phase at a high temperature and to ensure hardenability. However, since its addition at 0.5% or more excessively stabilizes the austenite phase, quench hardening takes place even when slow cooling is applied after heat treatment making it difficult to realize temper softening during working into a brake disc. Therefore, the addition amount is set at less than 0.5%.

Cr is one of the fundamental elements necessary for maintaining rusting resistance required of a brake disc for a two-wheeled vehicle, and if its content is less than 10% the required rusting resistance cannot be obtained. If more than 15% of Cr is added, on the other hand, the temperature range for forming the austenite phase narrows at a high temperature causing the formation of a ferrite phase, which does not transform into a martensite phase in the quenching temperature range, and thus the required hardness after quenching cannot be obtained. For that reason, the range of the Cr content is set at 10 to 15%.

Nb is an important element for suppressing temper softening resulting from heat generation caused by braking and thus is an indispensable addition element to achieve the object of the present invention. In order to demonstrate the effect, it is necessary to add at least 0.02% of Nb, but an addition exceeding 0.5% results in the deterioration of toughness. For that reason, the upper limit is set at 0.5%.

It is considered that the effect of Nb on suppressing temper softening is obtained in the way that Nb suppresses the recovery phenomenon where the steel matrix softens due to the disappearance by heating of many dislocations formed during martensitic transformation and also, by forming fine Nb carbonitrides, suppresses softening due to the formation of coarse Cr carbonitrides.

FIG. 1 shows the relationship between the tempering temperature and the hardness of the steels with the Nb addition of 0.06% and 0.14%, respectively (the steels are designated as D and E in Table 1 of Example 1), in comparison with a conventional steel without Nb addition (the steel is designated as U in Table 1 of Example 1). From the figure, it is confirmed that Nb addition in a small amount remarkably raises the temper softening temperature.

The amount of C+N relates directly to hardness after quenching and, in order to control the hardness to a prescribed level, it is necessary to keep the amount in the range of 0.04% to 0.1%.

Cu is, like Mn or Ni, an element effective to secure the austenite phase at a high temperature and to ensure hardenability, and significant effect is demonstrated with the addition of at least 0.1%. When the addition amount exceeds 2%, however, the steel hardens during heating for tempering, resulting in a marked decrease in toughness. For this reason, the upper limit is set at 2%.

Mo is, like Cr, an element which improves rusting resistance and further enhances the quality of a brake disc since it suppresses a decrease in toughness during tempering. To obtain these effects, it is necessary to add at least 0.1% of Mo. However, if more than 1% of Mo is added, like Cr, the temperature range for forming the austenite phase narrows at a high temperature causing formation of a ferrite phase, which does not transform into a martensite phase in a quenching temperature range, and thus the required hardness after quenching cannot be obtained.

Ti, V or B do not have so remarkable effect on suppressing temper softening as Nb does. However, when a proper quantity is added in combination with Nb, the effect of suppressing temper softening can be enhanced further. To demonstrate the effect, it is necessary to add not less than 0.01% of Ti or V or not less than 0.0005% of B. However, if more than 0.5% of Ti or V or more than 0.01% of B is added, toughness deteriorates markedly, and thus these figures are determined to be the upper limits for these elements, respectively.

The range of addition amount of each of the constituent elements and the reason for restricting the range are as described above.

For stably retaining hardness after quenching within the prescribed range, in addition to the prescription of each of the constituent elements, it is necessary to control the balance of the chemical composition which influences the austenite range at a high temperature. As an index which determines the austenite range, $\gamma_p$ expressed by the equation shown below is effective. The temperature range for forming the austenite phase at a high temperature can be secured by controlling the chemical composition so that $\gamma_p$ calculated by the equation is 70 or higher. However, it is preferable to maintain the value of $\gamma_p$ at 80 or higher for ensuring a sufficient quenching temperature range in industrial heat treatment and for stably retaining hardness after quenching within the prescribed range.

$$\gamma_p = 420\times[\%\ C] + 470\times[\%\ N] + 23\times[\%\ Ni] + 9\times[\%\ Cu] + 7\times[\%\ Mn] - 11.5\times[\%\ Cr] - 11.5\times[\%\ Si] - 12\times[\%\ Mo] - 47\times[\%\ Nb] - 52\times[\%\ Al] - 49\times[\%\ Ti] - 23\times[\%\ V] - 500\times[\%\ B] + 189$$

As for other unavoidable impurities, it is desirable to control them within the following ranges:

It is desirable that the contents of S and O be 0.02% or less since they cause rust by forming sulfides in the case of S and oxides in the case of O.

It is desirable that the content of P be 0.05% or less since it deteriorates toughness during quenching and heating for tempering.

Although Al is effective as a deoxidizing agent, if added excessively, it reacts with slag during smelting, resulting in the increase of CaS type inclusions in steel and causing rust generation. For this reason, it is desirable to control the content to 0.03% or less.

EXAMPLE 1

Ingots having the chemical compositions shown in Table 1 were produced and hot rolled to a thickness of 5 mm. Then, after being heated to 850° C. and subjected to heat treatment for softening by slow cooling, steel sheets were cut out for a variety of heat treatments. Each sheet was subsequently heated to 950° C. by high frequency heating and was held for 10 min., and then was subjected to quenching heat treatment by water-cooling. Test pieces for hardness measurement, evaluation of rusting resistance and JIS No. 4 sub-size impact test were cut out from some of the as-quenched sheets. Other as-quenched sheets were further heated to 400° to 700° C., held for 1 hour and then subjected to heat treatment by air-cooling. Test pieces for hardness measurement to examine softening properties, evaluation of rusting resistance and JIS No. 4 sub-size impact test were, likewise, cut out from them.

The softening properties were evaluated by the tempering temperature to soften the steel to less than 30 HRC by measuring hardness with the Rockwell hardness test method (JIS Z 2245). The rusting resistance was evaluated by polishing the surface of the test pieces to a roughness of No. 400 and subjecting them to a 100-hour salt spray test (JIS Z 2371). The toughness was evaluated by the Charpy impact value obtained from the Charpy impact test of the test pieces at a temperature of 25° C. (JIS Z 2242). The results are shown in Table 2.

From Table 2, it can be seen that every steel according to the present invention has a high temper softening temperature and the temper softening temperature for retaining the hardness of at least 30 HRC exceeds 530° C. for every steel. Also, it can be seen that impact values and rusting resistance are excellent. In case of the comparative steels not containing Nb, the temper softening temperature is as low as around 500° C. Further, the other comparative steels with inappropriate addition amounts of Nb or inappropriate other components are not suitable as materials for brake discs because of insufficient hardness after quenching, low toughness, etc.

The present invention can provide a steel having excellent resistance to temper softening resulting from heat generation caused by braking and, further, can provide the hardenability, rusting resistance and toughness required of a material for a brake disc, and thus is applicable to a brake disc for a two-wheeled vehicle for which a high braking capacity is required.

TABLE 1

| No | C | Si | Mn | P | S | Cr | Ni | Nb | Cu | Mo | Ti | V | B | Al | N | C + N | $\gamma_P$ | Remarks |
|---|---|---|---|---|---|---|---|---|---|---|---|---|---|---|---|---|---|---|
| A | 0.048 | 0.26 | 1.48 | 0.027 | 0.008 | 12.2 | 0.1 | 0.06 | 0.61 | | | | | 0.008 | 0.019 | 0.067 | 89.71 | Invented steel |
| B | 0.053 | 0.31 | 1.49 | 0.026 | 0.009 | 12.1 | 0.1 | 0.12 | 0.65 | | | | | 0.006 | 0.019 | 0.072 | 90.10 | Invented steel |
| C | 0.056 | 0.19 | 1.58 | 0.026 | 0.008 | 12.0 | 0.2 | 0.21 | 0.53 | | | | | 0.009 | 0.016 | 0.072 | 89.95 | Invented steel |
| D | 0.063 | 0.21 | 0.97 | 0.026 | 0.007 | 12.2 | 0.1 | 0.06 | | | | | | 0.004 | 0.016 | 0.079 | 86.33 | Invented steel |
| E | 0.066 | 0.29 | 1.58 | 0.030 | 0.008 | 12.1 | 0.2 | 0.14 | | | | | | 0.006 | 0.015 | 0.081 | 90.05 | Invented steel |
| F | 0.049 | 0.14 | 1.87 | 0.031 | 0.006 | 12.1 | 0.3 | 0.31 | | | | | | 0.004 | 0.015 | 0.064 | 81.08 | Invented steel |
| G | 0.057 | 0.16 | 1.49 | 0.027 | 0.007 | 12.0 | 0.2 | 0.08 | | 0.21 | | | | 0.005 | 0.019 | 0.076 | 90.52 | Invented steel |
| H | 0.056 | 0.18 | 1.82 | 0.025 | 0.005 | 11.9 | 0.1 | 0.18 | | 0.38 | | | | 0.011 | 0.021 | 0.077 | 84.92 | Invented steel |
| I | 0.055 | 0.15 | 1.43 | 0.026 | 0.004 | 12.3 | 0.2 | 0.11 | 0.52 | 0.15 | | | | 0.007 | 0.021 | 0.076 | 90.75 | Invented steel |
| J | 0.048 | 0.22 | 1.55 | 0.026 | 0.007 | 12.2 | 0.1 | 0.09 | 0.65 | 0.27 | | | | 0.004 | 0.019 | 0.067 | 86.58 | Invented steel |
| K | 0.053 | 0.21 | 1.47 | 0.027 | 0.003 | 12.1 | 0.1 | 0.05 | 0.55 | 0.22 | | | | 0.007 | 0.020 | 0.073 | 91.28 | Invented steel |
| L | 0.049 | 0.13 | 1.78 | 0.031 | 0.008 | 12.2 | 0.1 | 0.26 | 1.23 | 0.55 | | | | 0.005 | 0.014 | 0.063 | 81.12 | Invented steel |
| M | 0.066 | 0.31 | 1.61 | 0.028 | 0.009 | 12.2 | 0.2 | 0.09 | | 0.28 | | | | 0.005 | 0.016 | 0.082 | 87.48 | Invented steel |
| N | 0.064 | 0.25 | 1.52 | 0.029 | 0.006 | 12.1 | 0.2 | 0.07 | | | | 0.04 | | 0.008 | 0.014 | 0.078 | 90.13 | Invented steel |
| O | 0.064 | 0.29 | 1.53 | 0.029 | 0.009 | 12.1 | 0.1 | 0.11 | | 0.27 | | 0.08 | | 0.005 | 0.017 | 0.081 | 83.66 | Invented steel |
| P | 0.061 | 0.30 | 1.59 | 0.030 | 0.007 | 12.1 | 0.3 | 0.12 | 0.34 | 0.19 | | 0.09 | | 0.006 | 0.018 | 0.079 | 90.81 | Invented steel |
| Q | 0.065 | 0.31 | 1.49 | 0.025 | 0.007 | 12.2 | 0.1 | 0.08 | 0.28 | | | 0.11 | | 0.005 | 0.016 | 0.081 | 91.19 | Invented steel |
| R | 0.061 | 0.12 | 0.89 | 0.018 | 0.004 | 12.3 | 0.1 | 0.06 | | | 0.08 | | | 0.007 | 0.018 | 0.079 | 81.68 | Invented steel |
| S | 0.069 | 0.27 | 1.67 | 0.031 | 0.005 | 12.1 | 0.1 | 0.10 | | 0.22 | 0.12 | | | 0.003 | 0.014 | 0.083 | 81.77 | Invented steel |
| T | 0.052 | 0.28 | 1.48 | 0.025 | 0.005 | 12.2 | 0.2 | 0.11 | | | | | 0.0032 | 0.009 | 0.015 | 0.067 | 82.09 | Invented steel |
| U | 0.055 | 0.23 | 1.51 | 0.025 | 0.004 | 12.1 | 0.2 | 0.08 | 0.55 | 0.33 | | | 0.0011 | 0.008 | 0.018 | 0.073 | 89.05 | Invented steel |
| V | 0.059 | 0.23 | 1.64 | 0.024 | 0.007 | 12.1 | 0.1 | 0.08 | 0.54 | 0.21 | 0.04 | 0.05 | 0.0009 | 0.005 | 0.019 | 0.078 | 90.61 | Invented steel |
| W | 0.053 | 0.28 | 1.55 | 0.029 | 0.008 | 12.1 | 0.1 | | | | | | | 0.005 | 0.018 | 0.071 | 90.24 | Comparative steel |
| X | 0.067 | 0.18 | 1.55 | 0.031 | 0.011 | 12.2 | 0.1 | | | 0.22 | | | | 0.051 | 0.018 | 0.085 | 89.25 | Comparative steel |
| Y | 0.062 | 0.28 | 0.88 | 0.025 | 0.006 | 12.0 | 0.1 | | | | | 0.08 | | 0.004 | 0.017 | 0.079 | 90.06 | Comparative steel |
| Z | 0.062 | 0.28 | 1.49 | 0.025 | 0.006 | 12.1 | 0.2 | 0.72 | | | | | | 0.008 | 0.016 | 0.078 | 60.96 | Comparative steel |
| ZA | 0.061 | 0.15 | 1.87 | 0.027 | 0.008 | 12.1 | 0.1 | 0.12 | | 1.67 | | | | 0.003 | 0.014 | 0.075 | 69.88 | Comparative steel |
| ZB | 0.058 | 0.21 | 1.55 | 0.030 | 0.006 | 12.1 | 0.1 | 0.15 | 2.97 | | | | | 0.063 | 0.015 | 0.073 | 108.40 | Comparative steel |
| ZC | 0.048 | 0.37 | 0.56 | 0.026 | 0.007 | 12.4 | 0.1 | 0.08 | 0.32 | 0.29 | | | | 0.007 | 0.013 | 0.061 | 69.91 | Comparative steel |

TABLE 2

| No | Hardness after quenching (HRC) | Charpy impact value ($kg/cm^2$) (As-quenched) | Charpy impact value ($kg/cm^2$) (Tempered at 500° C.) | Salt spray test result (Rusting) | Tempering temperature to lower hardness to below 30 HRC (° C.) | Remarks |
|---|---|---|---|---|---|---|
| A | 34.5 | 5.6 | 4.3 | Not rusted | 570 | Invented steel |
| B | 36.2 | 4.8 | 4.0 | Not rusted | 620 | Invented steel |
| C | 36.5 | 4.7 | 3.6 | Not rusted | 650 | Invented steel |
| D | 36.7 | 5.2 | 4.3 | Not rusted | 580 | Invented steel |
| E | 36.9 | 4.8 | 3.6 | Not rusted | 630 | Invented steel |
| F | 34 | 5.2 | 4.1 | Not rusted | 660 | Invented steel |
| G | 36.5 | 5.4 | 5.6 | Not rusted | 600 | Invented steel |
| H | 35.3 | 5.6 | 5.4 | Not rusted | 610 | Invented steel |
| I | 36.2 | 4.8 | 5.0 | Not rusted | 590 | Invented steel |
| J | 34.8 | 5.5 | 5.8 | Not rusted | 580 | Invented steel |

TABLE 2-continued

| No | Hardness after quenching (HRC) | Charpy impact value ($kg/cm^2$) (As-quenched) | Charpy impact value ($kg/cm^2$) (Tempered at 500° C.) | Salt spray test result (Rusting) | Tempering temperature to lower hardness to below 30 HRC (° C.) | Remarks |
|---|---|---|---|---|---|---|
| K | 36.2 | 4.9 | 4.9 | Not rusted | 570 | Invented steel |
| L | 32.8 | 6.2 | 6.3 | Not rusted | 630 | Invented steel |
| M | 37.3 | 4.6 | 4.8 | Not rusted | 590 | Invented steel |
| N | 37.8 | 4.5 | 3.6 | Not rusted | 590 | Invented steel |
| O | 33.8 | 5.8 | 5.7 | Not rusted | 630 | Invented steel |
| P | 35.6 | 5.4 | 5.6 | Not rusted | 640 | Invented steel |
| Q | 37.5 | 4.7 | 3.6 | Not rusted | 660 | Invented steel |
| R | 33.3 | 5.3 | 3.5 | Not rusted | 580 | Invented steel |
| S | 32.9 | 5.4 | 5.5 | Not rusted | 600 | Invented steel |
| T | 35.3 | 4.9 | 3.5 | Not rusted | 630 | Invented steel |
| U | 36.1 | 5.1 | 4.6 | Not rusted | 600 | Invented steel |
| V | 37.2 | 4.7 | 5.0 | Not rusted | 630 | Invented steel |
| W | 35.8 | 5.2 | 5.1 | Not rusted | 510 | Comparative steel |
| X | 37.9 | 4.8 | 5.3 | Rusted | 490 | Comparative steel |
| Y | 37.4 | 5.4 | 4.4 | Not rusted | 500 | Comparative steel |
| Z | 27.8 | 1.8 | 0.9 | Not rusted | | Comparative steel |
| ZA | 28.7 | 3.1 | 2.4 | Not rusted | | Comparative steel |
| ZB | 35.7 | 4.3 | 0.6 | Rusted | 510 | Comparative steel |
| ZC | 28.2 | 4.5 | 5.1 | Not rusted | | Comparative steel |

What is claimed is:

1. Brake disc excellent in resistance to temper softening, characterized in that: said brake disc is a hot-rolled stainless steel sheet quenched to a martensitic stainless steel sheet and said steel consists essentially of in terms of wt %, C: 0.01 to 0.1%, N: 0.014 to 0.03%, C+N: 0.04 to 0.1%, Si: 1% or less, Mn: 2% or less, Ni: less than 0.5%, Cr: 10 to 15%, and Nb: 0.02 to 0.5%, with the balance Fe and unavoidable impurities; wherein the hardness after quenching heat treatment is in the range of 30 to 40 HRC; and the temper softening temperature for lowering the hardness to below 30 HRC is at least 530° C.; and wherein a value of $\gamma_p$ calculated from steel chemical ion as expressed below is at least 80%;

$$\gamma_p=420\times[\%\ C]+470\times[\%\ N]+23\times[\%\ Ni]+9\times[\%\ Cu]+7\times[\%\ Mn]-11.5\times[\%\ Cr]-11.5\times[\%\ Si]-12\times[\%\ Mo]-47\times[\%\ Nb]-52\times[\%\ Al]-49\times[\%\ Ti]-23\times[\%\ V]-500\times[\%\ B]+189.$$

2. Brake disc produced by a hot-rolled stainless steel excellent in resistance to temper softening according to claim 1, characterized by further containing, in terms of wt %, at least one of the following elements:

Cu: 0.1 to 2%, or

Mo: 0.1 to 1%.

3. Brake disc produced by a hot-rolled stainless steel excellent in resistance to temper softening according to claim 1 or 2, characterized by further containing, in terms of wt %, at least one of the following elements:

Ti: 0.01 to 0.5%,

V: 0.01 to 0.5%, or

B: 0.0005 to 0.01%.

* * * * *